US009903163B2

(12) United States Patent
Pettiet

(10) Patent No.: US 9,903,163 B2
(45) Date of Patent: Feb. 27, 2018

(54) DRILL BIT AND CUTTERS FOR A DRILL BIT

(71) Applicants: DRILFORMANCE TECHNOLOGIES, LLC, Houston, TX (US); Zane Michael Pettiet, Tomball, TX (US)

(72) Inventor: Zane Michael Pettiet, Tomball, TX (US)

(73) Assignee: DRILFORMANCE TECHNOLOGIES, LLP, Houston, TX (US)

( * ) Notice: Subject to any disclaimer, the term of this patent is extended or adjusted under 35 U.S.C. 154(b) by 695 days.

(21) Appl. No.: 14/381,794

(22) PCT Filed: Feb. 28, 2013

(86) PCT No.: PCT/US2013/028339
§ 371 (c)(1),
(2) Date: Aug. 28, 2014

(87) PCT Pub. No.: WO2013/130819
PCT Pub. Date: Sep. 6, 2013

(65) Prior Publication Data

US 2015/0047912 A1 Feb. 19, 2015

Related U.S. Application Data

(60) Provisional application No. 61/606,062, filed on Mar. 2, 2012.

(51) Int. Cl.
*E21B 10/43* (2006.01)
*E21B 10/567* (2006.01)
*E21B 10/55* (2006.01)
*E21B 10/62* (2006.01)

(52) U.S. Cl.
CPC ..... *E21B 10/43* (2013.01); *E21B 10/55* (2013.01); *E21B 10/5673* (2013.01); *E21B 10/5676* (2013.01); *E21B 10/62* (2013.01)

(58) Field of Classification Search
CPC ..... E21B 10/43; E21B 10/55; E21B 10/5673; E21B 10/5676; E21B 10/62; E21B 10/42; E21B 10/425; E21B 10/567; E21B 10/5735; E21B 10/36; E21B 7/00; E21B 10/54; E21B 10/58; E21B 10/00
See application file for complete search history.

(56) References Cited

U.S. PATENT DOCUMENTS

| | | | |
|---|---|---|---|
| 4,928,777 | A | 5/1990 | Shirley-Fisher |
| 2009/0057031 | A1 | 3/2009 | Patel et al. |
| 2010/0059288 | A1 | 3/2010 | Hall et al. |
| 2011/0278073 | A1 | 11/2011 | Gillis |

FOREIGN PATENT DOCUMENTS

| | | |
|---|---|---|
| EP | 1052367 | 11/2000 |

*Primary Examiner* — Wei Wang
(74) *Attorney, Agent, or Firm* — Terrence N. Kuharchuk; Rodman & Rodman LLP

(57) ABSTRACT

In a fixed cutter drill bit, a hybrid cutter with a cutting edge including a substantially continuous curve interrupted by at least one arc discontinuity. In a fixed cutter drill bit, a contoured cutter with a contoured cutting face including a raised shape, wherein the raised shape has a raised shape axis which is oblique to a drill bit body axis. In a cutter for a fixed cutter drill bit, a chamfer including a side bevel and a cutting face bevel, wherein a cutting face bevel length is at least two times a side bevel length.

6 Claims, 14 Drawing Sheets

DRILL BIT AND CUTTERS FOR A DRILL BIT

TECHNICAL FIELD

Cutters for a fixed cutter drill bit and cutter configurations for a fixed cutter drill bit.

BACKGROUND OF THE INVENTION

A borehole is typically drilled using a drill bit which is attached to an end of a drill string. Rotary drilling is performed by rotating the drill bit. The drill bit may be rotated by rotating the drill string, by rotating the drill bit with a downhole drilling motor, or in some other manner.

A roller cone drill bit includes cones which rotate as the drill bit is rotated. Teeth which are positioned on the cones roll along the bottom of the borehole as the cones rotate. The teeth impact the bottom of the borehole as they roll and thereby crush and disintegrate rock in order to advance the borehole.

A fixed cutter drill bit typically includes no moving parts, but includes cutters which are attached to the body of the drill bit and which rotate with the drill bit as the drill bit is rotated. The cutters scrape the borehole as the drill bit rotates, thereby shearing rock in order to advance the borehole.

A cutter on a fixed cutter drill bit is typically comprised of a cutter element, such as an "abrasive" or "superabrasive" cutter element, which performs the shearing action. An abrasive cutter element may be comprised of tungsten carbide, another carbide material, ceramic and/or some other material. A superabrasive cutter element may be comprised of natural diamond, a synthetic diamond material such as polycrystalline diamond compact (PDC) or thermally stable diamond (TSP), or may be comprised of some other material such as cubic boron compact or diamond grit impregnated substances.

A cutter on a fixed cutter drill bit may be further comprised of a substrate to which the cutter element may be affixed. For example, a PDC or TSP cutter element may be comprised of a "diamond table" which may be affixed to a substrate such as tungsten carbide in order to provide the complete cutter. The cutter element defines a cutting face which contacts the borehole in order to perform the shearing action. The perimeter of the cutting face defines an edge of the cutting face. The cutting face may be flat or may be contoured. For example, a contoured cutting face may be comprised of a raised shape.

A PDC or TSP cutter element may typically be affixed to a substrate by applying high temperature and high pressure to the cutter element and substrate in the presence of a catalyst so that the materials of the cutter element and the substrate bond with each other.

Fixed cutter drill bits are therefore typically comprised of a drill bit body and a plurality of cutters which are attached to the drill bit body. The drill bit body is typically constructed of steel or of a matrix containing an erosion resistant material such as tungsten carbide. The cutters are typically attached to the drill bit body by an adhesive or by brazing. The cutters may be received in cutter pockets in the drill bit body in order to facilitate the attachment of the cutters to the drill bit body.

The drill bit body and the cutters are configured to provide an overall design for the drill bit, having regard to considerations such as drilling performance, durability and hydraulic performance of the drill bit.

As one example, the drill bit body typically includes a plurality of blades to which the cutters are attached and between which fluids and cuttings may pass. Because the cutters are typically attached to the blades of the drill bit, increasing the number of blades on a fixed cutter drill hit will generally increase the number of cutters which may be attached to the drill bit body, thereby increasing the "cutter count" and the "cutter density" on the drill bit.

Generally, the drilling performance (i.e. rate of penetration) which can be achieved by a fixed cutter drill bit is inversely proportional to the number of blades and cutters which are included in the drill bit. In other words, the greater the number of blades and the greater the number of cutters, the lower the rate of penetration which may be expected from the drill bit.

Generally, the durability of the drill bit is proportional to the number of blades and cutters which are included in the drill bit. In other words, the greater the number of blades and the greater the number of cutters, the longer the drill bit may be expected to function without experiencing excessive wear.

Generally, the hydraulic performance of the drill bit is inversely proportional to the number of blades which are included in the drill bit. In other words, the greater the number of blades, the less area which is available between the blades for the passage of fluids and cuttings, and the more resistance which is provided to the passage of fluids and cuttings past the drill bit.

As a second example, drill bits may embody different cutter shapes, cutter geometries and cutter layouts. These cutter shapes, cutter geometries and cutter layouts may be directed at maximizing drilling performance (i.e., aggressiveness) or durability of the drill bit.

Generally, angular cutters (in which the perimeter of the cutting face is generally polygonal, with straight sides connected by angles) are relatively aggressive, but are susceptible to failure. The shape of the perimeter of the cutting face of an angular cutter may, for example, be generally triangular, square, pentagonal, etc.

Generally, curved cutters (in which the perimeter of the cutting face is generally curved or circular, with a continuous curved or circular shape) are relatively durable, but tend to be less aggressive than angular cutters. The shape of the perimeter of the cutting face of a curved cutter may, for example, be generally round, oval, etc.

Generally, chamfering the edges of the perimeter of an angular cutter or a curved cutter can increase the durability of the cutter, while sacrificing some aggressiveness of the cutter.

In abrasive types of rock and/or in formations which subject the cutters to a high frequency of "impact" or transitional drilling, angular cutters may tend to break more frequently and more catastrophically than curved cutters.

Curved cutters may, however, encounter more difficulty than angular cutters in shearing through highly plastic formations. To reduce this difficulty, reduced chamfering of the edge of the cutting face can be provided to a curved cutter to improve the drilling performance of the bit, but at the expense of decreased durability, since the sharper cutter edge may have a greater tendency to chip or break.

All of these and many other environments may be encountered in the drilling of a single borehole. As a result, the drilling performance and durability of a fixed cutter bit may represent a compromise between design considerations such as the shape of the perimeter of the cutting face and or the extent and geometry of the chamfering of the edge of the cutting face.

Another potential problem inherent in fixed cutter bits relates to the cutters which are located at the distal end of the drill bit, and in particular, such cutters which are located at or adjacent to the centerline of the drill bit. These "center" cutters are susceptible to cutter damage due to "out of center rotation", which can occur when the centerline of the drill bit does not coincide with the centerline of the borehole being drilled. In such circumstances, a cutter located at or adjacent to the centerline of the drill bit may cross the centerline of the borehole during drilling, causing the cutter to move backward against the material being sheared and potentially resulting in damage to the cutter due to improper backward loading.

One solution to this potential problem is to avoid locating cutters at or directly adjacent to the centerline of the drill bit, thereby leaving a "core" of purposely uncut hole bottom at the end of the borehole and minimizing the risk of cutters crossing the centerline of the borehole during drilling. The presence of this core can be both beneficial and detrimental. The principal benefit of the core is that it can enhance drill bit stability, with the potential enhanced stability being generally proportional to the size of the core. The principal detriment of the core is that the core can cause damage to the drill bit and the cutters adjacent to the core because of undesirable side loading which may be imposed on the adjacent cutters as they contact the core during drilling.

There remains a need for fixed cutter drill bits which facilitate reasonable compromises with respect to the drilling performance, durability, and stability which can be achieved with the drill bit.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention relates to cutters for a fixed cutter drill bit, to cutter configurations for a fixed cutter drill bit, and to fixed cutter drill bits.

As contemplated herein, a "fixed cutter drill bit" is distinguished from a roller cone drill bit in that a fixed cutter drill bit typically includes no moving parts, but comprises a drill bit body and a plurality of cutters which are attached to the drill bit body.

The cutters rotate with the drill bit as the drill bit is rotated and scrape the borehole as the drill bit rotates, thereby shearing rock in order to advance the borehole. The cutters may be constructed of any suitable material or combination of materials.

The cutters are comprised of cutter elements which perform the shearing action.

In some embodiments, a cutter element may be an "abrasive" cutter element or a "superabrasive" cutter element. In some embodiments, an abrasive cutter element may be comprised of tungsten carbide, another carbide material, ceramic and/or some other material. In some embodiments, a superabrasive cutter element may be comprised of natural diamond, a synthetic diamond material such as polycrystalline diamond compact (PDC) or thermally stable diamond (TSP), or may be comprised of some other material such as cubic boron compact or diamond grit impregnated substances.

In some embodiments, the cutters may be further comprised of substrates to which the cutter elements may be affixed. The substrates may be comprised of any suitable material or combination of materials.

For example, in some embodiments a PDC or TSP cutter element may be comprised of a "diamond table" which may be affixed to a substrate such as tungsten carbide in order to provide a complete cutter. The cutter element defines a cutting face which contacts the borehole in order to perform the shearing action. The perimeter of the cutting face defines an edge of the cutting face. The cutting face may be flat or may be contoured. For example, a contoured cutting face may be comprised of a raised shape.

A cutter element may be affixed to a substrate in any suitable manner. In some embodiments, a PDC or TSP cutter element may be affixed to a substrate by applying high temperature and high pressure to the cutter element and the substrate in the presence of a catalyst so that the materials of the cutter element and the substrate bond with each other.

The drill bit body may be constructed of any suitable material or combination of materials. In some embodiments, the drill bit body may be constructed of steel or of a matrix. A matrix may contain an erosion resistant material. The erosion resistant material may be comprised of tungsten carbide, so that in some embodiments, the drill bit body may be considered to be constructed of a tungsten carbide matrix.

The drill bit body may be constructed as a single piece or the drill bit body may be comprised of a plurality of components which are connected together to provide the drill bit body. Components of the drill bit body may be constructed of the same material or of different materials.

The drill bit body and/or components of a drill bit body may be formed in any suitable manner. In some embodiments, the drill bit body and/or components thereof may be cast. In some embodiments, the drill bit body and/or components thereof may be milled.

The cutters may be attached to the drill bit body in any suitable manner. In some embodiments, the cutters may be attached to the drill bit body with an adhesive. In some embodiments, the cutters may be attached, to the drill bit body by brazing. In embodiments in which the cutters are comprised of substrates, the cutters may be attached to the drill bit body by attaching the substrates of the cutters to the drill bit body.

In some embodiments, the drill bit body may define cutter pockets and the cutters may be received in the cutter pockets for attachment with the drill bit body. In some embodiments alignment aids may be associated with the cutters and/or the cutter pockets for assisting in positioning the cutters in the cutter pockets at a desired orientation.

The drill bit has a bit axis. The bit axis may be defined by the drill bit body. The drill bit has a gauge diameter. The gauge diameter represents a nominal diameter of the borehole which is drilled using the drill bit.

The drill bit body has a proximal end which is adapted for connecting with a drill string and the drill bit body has a distal end.

In some embodiments, the proximal end of the drill bit body may be comprised of a threaded connector for connecting the drill bit with the drill string. As contemplated herein, a "drill string" includes pipe, tubing and/or any other tool, coupling or connector which may be included in an assembly of components which may be referred to as a drill string.

In some embodiments, the proximal end of the drill bit body may be comprised of a pin type connector for engaging with a box type connector associated with the drill string. In some embodiments, the proximal end of the drill bit body may be comprised of a box type connector for engaging with a pin type connector associated with the drill string.

In some embodiments, the drill bit body may be comprised of a plurality of blades which extend from the distal end of the drill bit body toward the proximal end of the drill bit body. In some embodiments, the blades may be comprised of spiral blades.

The drill bit body may be comprised of any suitable number of blades. In some embodiments, the drill bit body may be comprised of between about three blades and about six blades.

In some embodiments, the blades may define a cutting profile between the drill bit body axis and the gauge diameter. The cutting profile represents the portion of the drill hit which is presented to the bottom of a borehole in order to drill the borehole and the cutting profile defines the overall shape of the bottom of the borehole.

In some embodiments, the cutting profile may be designed having regard to a number of considerations, including but not limited to drilling performance, drill bit durability, drill bit stability, and hydraulic performance of the drill bit.

The cutters may be attached to the drill bit body at any suitable location or locations on the drill bit body. The cutters are positioned and oriented on the drill bit body so that the cutting faces of the cutter elements may engage the borehole and thus provide cutting paths for the cutters as the drill bit rotates. Some cutters may be positioned and oriented so that the cutting faces are substantially perpendicular to the direction of rotation of the drill bit. Some cutters may be positioned and oriented so that the cutting faces are substantially parallel to the direction of rotation of the drill bit.

Cutters which are positioned and oriented on that the cutting faces are substantially perpendicular to the direction of rotation of the drill bit may be positioned on the drill bit body so that the cutting faces of the cutters exhibit an "exposure". The "exposure" of a cutting face is the extent to which the cutting face protrudes from the drill bit body so that it is capable of engaging the borehole and thus providing the cutting path. The perimeter of the cutting face around the portion of the cutting face which exhibits the exposure provides a "cutting edge", which defines the peripheral limit of the cutting path of the cutter. The cutting edge of a cutter may be provided with a chamfer to provide improved durability and impact resistance of the cutter.

Cutters which are positioned and oriented so that the cutting faces are substantially perpendicular to the direction of rotation of the drill bit may be positioned so that the cutting faces provide a "siderake angle" and/or "backrake angle" relative to the direction of rotation. A "siderake angle" of a cutting face is the angle of the cutting face relative to the plane of rotation of the cutting face. A "backrake angle" of a cutting face is the angle of inclination of the cutting face within the plane of rotation of the drill bit.

Whether the cutters are positioned and oriented so that the cutting faces are substantially perpendicular or substantially parallel to the direction of rotation, cutters may be oriented on the drill bit body so that the cutting faces of the cutters provide a desired amount of "offset" relative to each other. The "offset" of cutting faces is the extent to which cutting faces are radially spaced from each other. Two cutting faces provide no offset if they completely overlap radially as the drill bit rotates. Two cutting faces provide a complete offset if they do not overlap at all radially as the drill bit rotates.

The cutting edge and the cutting path of an individual cutter are dependent upon factors such as the shape and size of the cutter and the exposure of the cutter. The effective cutting edge and the effective cutting path of an individual cutter in a set of cutters is further dependent upon the offset and the relative exposures of the cutters, since a leading cutter may partially or fully cover or project upon the cutting edge and the cutting path of a trailing cutter.

In some embodiments, a plurality of cutters may be attached to the blades. In some embodiments in which a plurality of cutters is attached to the blades, cutters may also be attached to the drill bit body at locations other than the blades.

In some embodiments, a plurality of cutters may be distributed on the blades in a cutter layout along the cutting profile. The cutter layout determines the contribution which each cutter makes to the drilling of the borehole as the drill bit is rotated in the borehole. The contribution which each cutter makes to the drilling of the borehole is dependent upon a number of variables, including but not limited to cutter shape, cutter size, cutter count, cutter density, cutter siderake angle, cutter backrake angle, cutter exposure, and cutter offset.

The cutters may be positioned on the drill bit body in the cutter layout in any suitable manner. In some embodiments, the cutters may be positioned in the cutter layout by making suitable measurements before attaching the cutters to the drill bit body. In some embodiments, the cutters, the drill bit body and/or the cutter pockets may be provided, with alignment aids such as shaped holes, grooves or lugs so that the cutters may be positioned at a desired orientation on the drill bit body to achieve a desired cutter layout.

In some embodiments, the cutter layout may be designed having regard to a number of considerations relating to the performance of the drill bit, including but not limited to drilling performance, durability and/or stability, which may be dependent upon the contribution which each cutter makes to the drilling of the borehole and upon the variables listed above.

In some embodiments, the present invention may relate more specifically to features of individual cutters for a fixed cutter drill bit, to configurations of cutters in a fixed cutter drill bit, and/or to fixed cutter drill bits.

In a first aspect, the invention relates to hybrid cutters and to fixed cutter drill bits comprising one or more hybrid cutters. As used herein, a "hybrid cutter" is a cutter which combines features of an angular cutter (in which the perimeter of the cutting face is generally polygonal) and a curved cutter (in which the perimeter of the cutting face is generally curved or circular).

In the first aspect, a hybrid cutter may be comprised of a cutter element, wherein the cutter element has a cutting edge which is comprised of a substantially continuous curve interrupted by at least one arc discontinuity.

In the first aspect, the substantially continuous curve may be circular, oval or any other suitable shape which is capable of providing the substantially continuous curve. In some particular embodiments, the substantially continuous curve may be substantially circular.

As used herein, an arc discontinuity is a gap in the arc of the substantially continuous curve, which gap may be comprised of any discontinuity shape which is capable of providing the arc discontinuity. In some embodiments, the discontinuity shape may be selected from the group of shapes consisting of a straight discontinuity, a concave discontinuity, a convex discontinuity and a notch discontinuity.

In the first aspect, the arc discontinuities may be provided throughout all or only a portion of the length of the cutter.

In some embodiments of the first aspect, the cutter element and the entire length of the substrate may include the arc discontinuities. In some embodiments of the first aspect, the cutter element and a portion of the length of the substrate may include the arc discontinuities. In some embodiments of the first aspect, only the cutter element may include the arc discontinuities. In some embodiments of the first aspect, only a portion of the length of the cutter element may include the arc discontinuities. In some embodiments of the first aspect, the arc discontinuities may extend substantially parallel to the axis of the cutter. In some embodiments of the first aspect, the arc discontinuities may extend at an angle relative to the axis of the cutter so that the arc discontinuities are tapered along the length of the cutter element and/or the substrate.

In some embodiments of the first aspect, the invention is a fixed cutter drill bit comprising:

(a) a drill bit body; and (b) a hybrid cutter comprising a cutter element, wherein the cutter element defines a cutting face, wherein the cutting face has a perimeter, wherein the hybrid cutter is positioned on the drill bit body so that a portion of the cutting face exhibits an exposure, wherein the perimeter around the portion of the cutting face which exhibits the exposure provides a cutting edge, and wherein the cutting edge is comprised of a substantially continuous curve interrupted by at least one arc discontinuity.

In some embodiments of the first aspect, the substantially continuous curve of the cutting edge of the hybrid cutter may be interrupted by one arc discontinuity.

In embodiments of the first aspect in which the substantially continuous curve of the cutting edge of the hybrid cutter is interrupted, by one arc discontinuity, the hybrid cutter may be positioned on the drill bit body such that the portion of the cutting face of the hybrid cutter which exhibits the exposure defines a cutter centerline substantially normal to the drill bit body, and such that the one arc discontinuity does not intersect the cutter centerline. In some such embodiments of the first aspect, the substantially continuous curve of the cutting edge of the hybrid cutter may be substantially circular.

In some embodiments of the first aspect in which the substantially continuous curve of the cutting edge of the hybrid cutter is interrupted by one arc discontinuity, the fixed cutter drill bit may be further comprised of a second hybrid cutter. The second hybrid, cutter may be substantially identical to the hybrid cutter, or may be different from the hybrid cutter. In some such embodiments of the first aspect, the second hybrid cutter may be substantially identical to the hybrid, cutter, the portion of the cutting face of the second hybrid cutter which exhibits the exposure may define a second cutter centerline normal to the drill bit body, and the second hybrid cutter may be positioned on the drill bit body such that the one arc discontinuity does not intersect the second cutter centerline.

In some embodiments of the first aspect, the second hybrid cutter may be positioned on the drill bit body adjacent to the hybrid cutter such that the one arc discontinuity of the hybrid cutter and the one arc discontinuity of the second hybrid cutter are facing each other. In such embodiments of the first aspect, the hybrid cutter and the second hybrid cutter may provide a combined cutter configuration.

In some such embodiments of the first aspect, the hybrid cutter and the second hybrid cutter may be positioned on the drill bit body such that the cutter centerline and the second cutter centerline are substantially parallel to each other. In some such embodiments of the first aspect, the hybrid cutter and the second hybrid cutter may more particularly be positioned on the drill bit body such that they "mirror" each other. In these embodiments of the first aspect, the exposures of the hybrid cutter and the second hybrid cutter may together provide a combined cutter centerline and the exposures of the hybrid, cutter and the second hybrid cutter may be substantially symmetrical about the combined, cutter centerline.

In some embodiments of the first aspect, the substantially continuous curve of the cutting edge of the hybrid cutter may be interrupted by two arc discontinuities. The two arc discontinuities may be substantially identical to each other or may be different from each other.

In some embodiments of the first aspect in which the substantially continuous curve of the cutting edge of the hybrid cutter is interrupted by two arc discontinuities, the hybrid cutter may be positioned on the drill bit body such that the portion of the cutting face of the hybrid cutter which exhibits the exposure defines a cutter centerline substantially normal to the drill bit body, and such that the two arc discontinuities do not intersect the cutter centerline. In some such embodiments of the first aspect, the substantially continuous curve of the cutting edge of the hybrid cutter may be substantially circular.

In some embodiments of the first aspect in which the substantially continuous curve of the cutting edge of the hybrid cutter is interrupted by two arc discontinuities, the cutting edge of the hybrid cutter may be further comprised of a curved cutter tip between the two arc discontinuities. In some such embodiments of the first aspect, the curved cutter tip may represent a portion of the substantially continuous curve.

In some such embodiments of the first aspect, the cutter centerline may intersect the curved cutter tip. In some such embodiments of the first aspect, the hybrid cutter may be positioned on the drill bit body such that the portion of the cutting face of the hybrid cutter which exhibits the exposure is substantially symmetrical about the cutter centerline.

In some embodiments of the first aspect, the substantially continuous curve of the cutting edge of the hybrid cutter may be interrupted by at least three arc discontinuities. The at least three arc discontinuities may be substantially identical to each other or may be different from each other. The at least three arc discontinuities may be distributed around the cutting edge in any manner. In some such embodiments of the first aspect, the at least three arc discontinuities may be evenly spaced around the cutting edge of the hybrid cutter.

In some embodiments of the first aspect in which the substantially continuous curve of the cutting edge of the hybrid cutter is interrupted by at least three arc discontinuities, the cutting edge of the hybrid cutter may be further comprised of curved cutter tips between the at least three arc discontinuities. In some such embodiments of the first aspect, the curved cutter tips may represent a portion of the substantially continuous curve.

In some embodiments of the first aspect in which the substantially continuous curve of the cutting edge of the hybrid cutter is interrupted by at least three arc discontinuities, the hybrid cutter may be positioned on the drill bit body such that the portion of the cutting face of the hybrid cutter which exhibits the exposure defines a cutter centerline normal to the drill bit body, and such that the cutter centerline intersects at least one of the curved cutter tips.

In some embodiments of the first aspect in which the substantially continuous curve of the cutting edge of the hybrid cutter is interrupted by at least three arc discontinuities, the hybrid cutter may be positioned on the drill bit body such that the portion of the cutting face which exhibits the exposure is substantially symmetrical about the cutter centerline.

In the first aspect, a fixed cutter drill bit may be comprised of a single hybrid cutter or any suitable number of a plurality of hybrid cutters. In embodiments of the first aspect in which the fixed cutter drill bit is comprised of a plurality of hybrid cutters, the plurality of hybrid cutters may be substantially identical to each other or may be different from each other, the plurality of hybrid cutters may be positioned adjacent to each other or may be separated from each other, and/or the plurality of hybrid cutters may be configured to work independently during use of the drill bit or may be configured to complement each other during use of the drill bit.

In the first aspect, one or more alignment aids may be associated with a hybrid cutters and/or the fixed cutter drill bit in order to assist in positioning the hybrid cutter at a desired orientation on the drill bit body. An alignment aid may be comprised of any suitable structure, device or apparatus. In some embodiments of the first aspect, an alignment aid may be comprised of holes and/or grooves and complementary lugs.

In some embodiments of the first aspect, an alignment aid may be comprised of the shape of the cutter and a complementary recess in the drill bit body. As a non-limiting example, in some such embodiments of the first aspect, a cutter may include arc discontinuities spaced substantially evenly around the entire perimeter of the cutting face and the drill bit body may be configured to receive one or more arc discontinuities. When the cutter is positioned on the drill bit body, only the portion of the cutting face which exhibits the exposure provides the cutting face of the cutter. By spacing arc discontinuities substantially evenly around the entire perimeter of the cutting face, a worn or damaged cutter may potentially be turned to change the portion of the cutting face which exhibits the exposure so that the cutter can be re-used instead, of discarded, while the arc discontinuities and the drill hit body provide an alignment aid for positioning the cutter on the drill hit body.

In a second aspect, the invention relates to contoured cutters and to fixed cutter drill bits comprising one or more contoured cutters. As used herein, a "contoured cutter" is a cutter which has a contoured cutting face, wherein the contoured cutting face is comprised of a raised shape. In the second aspect, the raised shape may be any suitable shape.

In the second aspect, one or more contoured cutters may be positioned on a distal end of a drill bit body such that the raised shapes extend away from the distal end of the drill bit body in a distal direction. As used herein, "distal direction" means a substantially longitudinal direction with respect to the drill bit in contrast to a substantially transverse direction with respect to the drill bit.

In the second aspect, the drill bit body may have a drill bit body axis, a raised shape may have a raised shape axis, and the raised shape axis may be oblique to the drill bit body axis. As used herein, "oblique to the drill bit body axis" means that the raised shape axis is neither parallel nor perpendicular to the drill bit body axis.

In the second aspect, a contoured cutter may have a contoured cutter axis. The raised shape axis may be parallel or coincident with the contoured cutter axis or the raised shape axis may be oblique to the contoured cutter axis. If the raised shape axis is parallel or coincident with the contoured cutter axis, the contoured cutter may be positioned on the drill bit body so that the raised shape axis is oblique to the drill bit body axis.

It is believed that the combination of the raised shape and the oblique raised shape axis may provide a wider range of loading angles for the distal end of the drill bit, and that this wider range of loading angles may possibly enhance drilling performance and/or increase the durability of the drill bit.

In some embodiments of the second aspect, the invention is a fixed cutter drill bit comprising:

(a) a drill hit body having a distal end and a drill hit body axis; and (b) a contoured cutter positioned on the distal end of the drill bit body, wherein the contoured cutter comprises a cutter element, wherein the cutter element defines a cutting face, wherein the cutting face is a contoured cutting face, wherein the contoured cutting face is comprised of a raised shape extending away from the distal end of the drill bit body in a distal direction, wherein the raised shape defines a raised shape axis, and wherein the raised shape axis is oblique to the drill bit body axis.

In some embodiments of the second aspect, a contoured cutter may be positioned on the drill bit body such that drill bit body axis passes through the contoured cutter, in which case the contoured cutter may be referred to as a center cutter. In such embodiments, the raised shape axis may intersect the drill bit body axis so that the raised shape crosses the drill bit body axis. In some embodiments of the second aspect in which a contoured cutter is a center cutter, the center cutter may define a center cutter axis, the raised shape axis may be oblique to the center cutter axis, and the contoured cutter may be positioned on the drill bit body such that the center cutter axis is substantially coincident with the drill bit body axis.

In some embodiments of the second aspect, the drill bit may be comprised of a plurality of contoured cutters. The plurality of contoured cutters may be substantially identical to each other or may be different from each other. The plurality of contoured cutters may be positioned on the drill bit body substantially identically or may be positioned on the drill bit at varying positions and with varying angles and orientations of the raised shape axes.

In some embodiments of the second aspect in which the drill bit is comprised of a plurality of contoured cutters, each of the contoured cutters may be positioned on the distal end of the drill hit body. In some such embodiments of the second aspect, the raised shape of each of the contoured cutters may extend away from the distal end of the drill bit body in the distal direction. In some such embodiments of the second aspect, the raised shape axis of each of the contoured cutters may be oblique to the drill bit body axis. In some such embodiments of the second aspect, at least one of the contoured cutters may be a center cutter.

In some embodiments of the second aspect, the raised shape may have a base, a tip, a height and a width. In some embodiments of the second aspect, the width of the raised shape at the tip may be smaller than the width of the raised shape at the base. In some embodiments, the raised shape may be substantially cone-shaped (i.e., tapered) between the base and the tip. The tapering of the raised shape may extend for the entire height of the raised shape or for only a portion of the height of the raised shape. In some embodiments of the second aspect, the raised shape may be selected from the group of shapes consisting of a straight cone, a concave cone, a convex cone, and a polygonal cone.

In the second aspect, the base of the raised shape may be any suitable shape. In some embodiments of the second aspect, the base of the raised shape may be substantially circular. In some embodiments of the second aspect, the base of the raised shape may be substantially polygonal.

In the second aspect, the tip of the raised shape may be any suitable shape. In some embodiments of the second aspect, the tip of the raised shape may be substantially flat. In some embodiments of the second aspect, the tip of the raised shape may be contoured. In some embodiments of the second aspect, the tip of the raised shape may be substantially spherical.

In a third aspect, the invention elates to chamfers for the edges of the cutting faces of fixed cutters and to fixed cutter drill bits comprising chamfered cutters. In the third aspect, the invention relates to the specific proportions and size of the chamfer which is applied to the edge of the cutting face of a fixed cutter. It is believed that the third aspect of the invention provides an attractive balance between drilling performance and durability for fixed cutters and fixed cutter drill bits.

In some embodiments of the third aspect, the invention is a cutter for a fixed cutter drill bit, wherein the cutter is comprised of a cutter element, wherein the cutter element defines a cutting face and a side adjacent to the cutting face, wherein the cutting face has a perimeter, wherein the perimeter of the cutting face defines an edge between the cutting face and the side of the cutter element, wherein at least a portion of the edge is chamfered to provide a transition between the cutting face and the side of the cutter element, wherein the chamfer is comprised of a side bevel and a cutting face bevel, wherein the side bevel has a side bevel length, wherein the cutting face bevel has a cutting face bevel length, and wherein the cutting face bevel length is at least two times the side bevel length.

In the third aspect, the actual dimensions of the side bevel length and the cutting face bevel length may depend upon the size, shape and configuration of the cutter to which the chamfer is applied. In some embodiments of the third aspect, the side bevel length may be less than 0.3 millimeters.

In the third aspect, the chamfer of the invention may be applied to all or only a portion of the edge of a cutting face of any of the cutters in a fixed cutter drill bit.

In some embodiments, the third aspect of the invention may be utilized in the first aspect of the invention so that the chamfer of the third aspect of the invention may be applied to all or a portion of the cutting edge of the hybrid cutters of the first aspect of the invention.

The first aspect, the second aspect and the third aspect of the invention may be incorporated into a fixed cutter drill bit together or individually. The first aspect, the second aspect and/or the third aspect of the invention may be incorporated into cutter layouts for a wide range of fixed cutter drill bits. Without limiting the generality of the foregoing, the first aspect, the second aspect and/or the third aspect of the invention may be incorporated into fixed cutter drill bits as described in U.S. Patent Application Publication No. US 2011/0278073 A1 (Gillis).

BRIEF DESCRIPTION OF DRAWINGS

Embodiments of the invention will now be described with reference to the accompanying drawings, in which.

DETAILED DESCRIPTION

The present invention relates to fixed cutter drill bits and to features of a fixed cutter drill bit.

Figure 1:
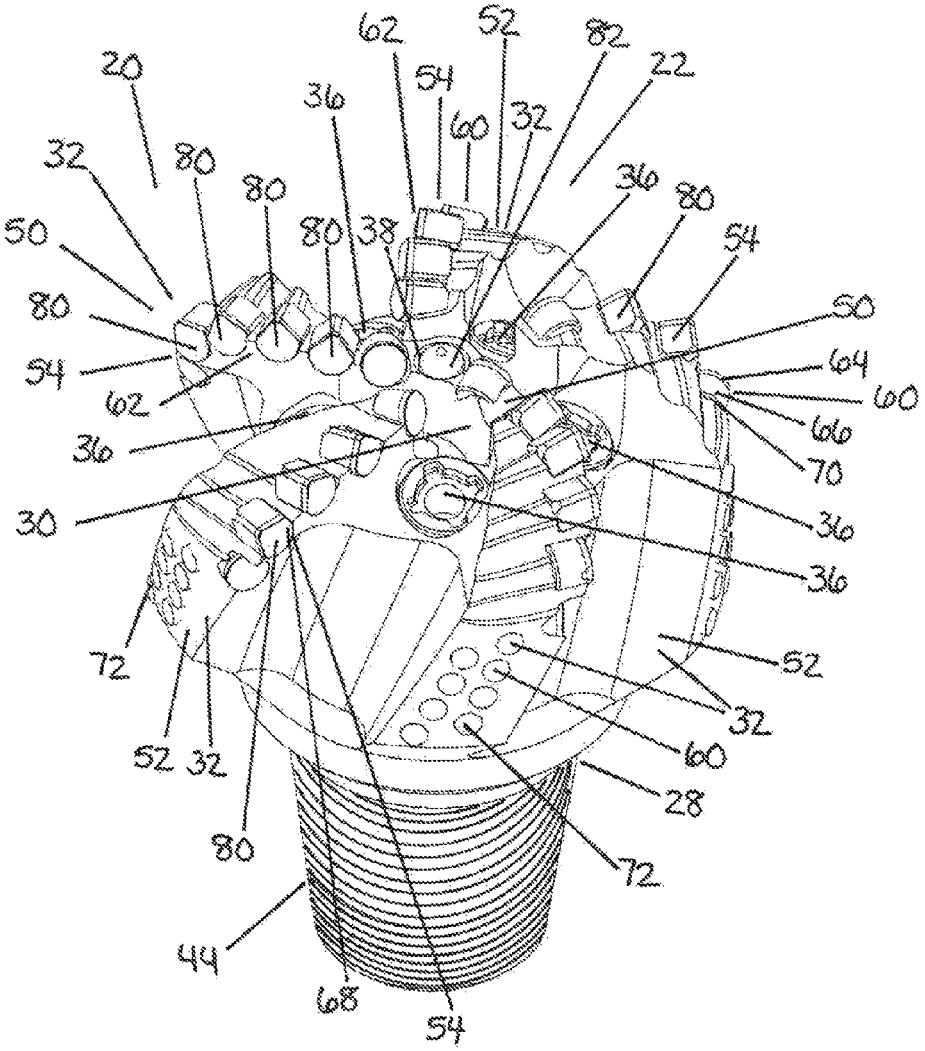
FIG. 1 is a pictorial view of a first embodiment of drill bit including features of the invention.
Figure 24:
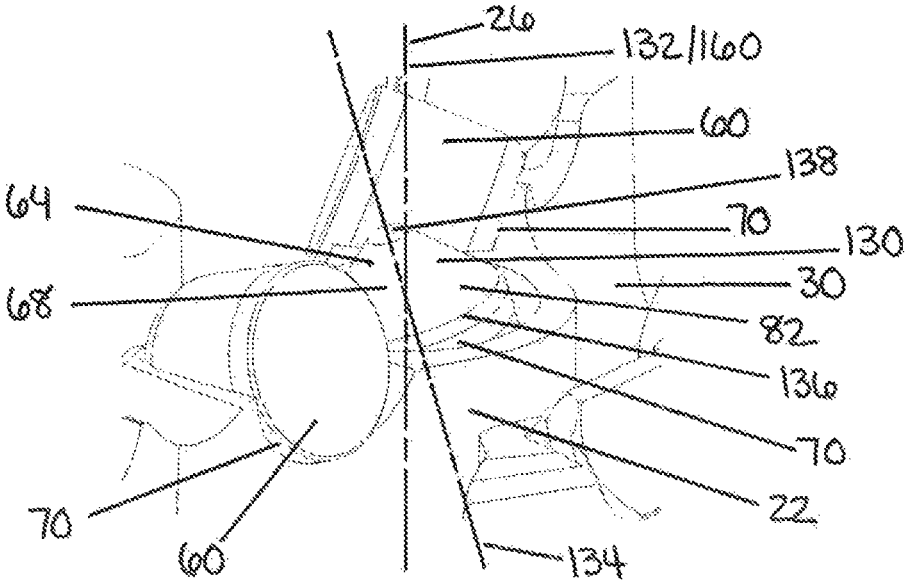
FIG. 24 is a pictorial view of the distal end of the first embodiment of drill bit depicted in FIG. 1, detailing an embodiment of a contoured cutter according to the invention.

A first embodiment of a fixed cutter drill bit incorporating embodiments of features of the invention is depicted in FIG. 1 and FIG. 24. A second embodiment of a fixed cutter drill bit incorporating embodiments of features of the invention is depicted in FIG. 2 and FIG. 3.

Exemplary embodiments of hybrid cutters according to the invention are depicted in FIGS. 5-16. Exemplary embodiments of alignment aids for hybrid cutters according to the invention are depicted in FIGS. 17-22. Exemplary embodiments of contoured cutters according to the invention are depicted in FIGS. 24-28. An exemplary embodiment of a chamfer for a fixed cutter according to the invention is depicted in FIG. 29.

Figure 2:
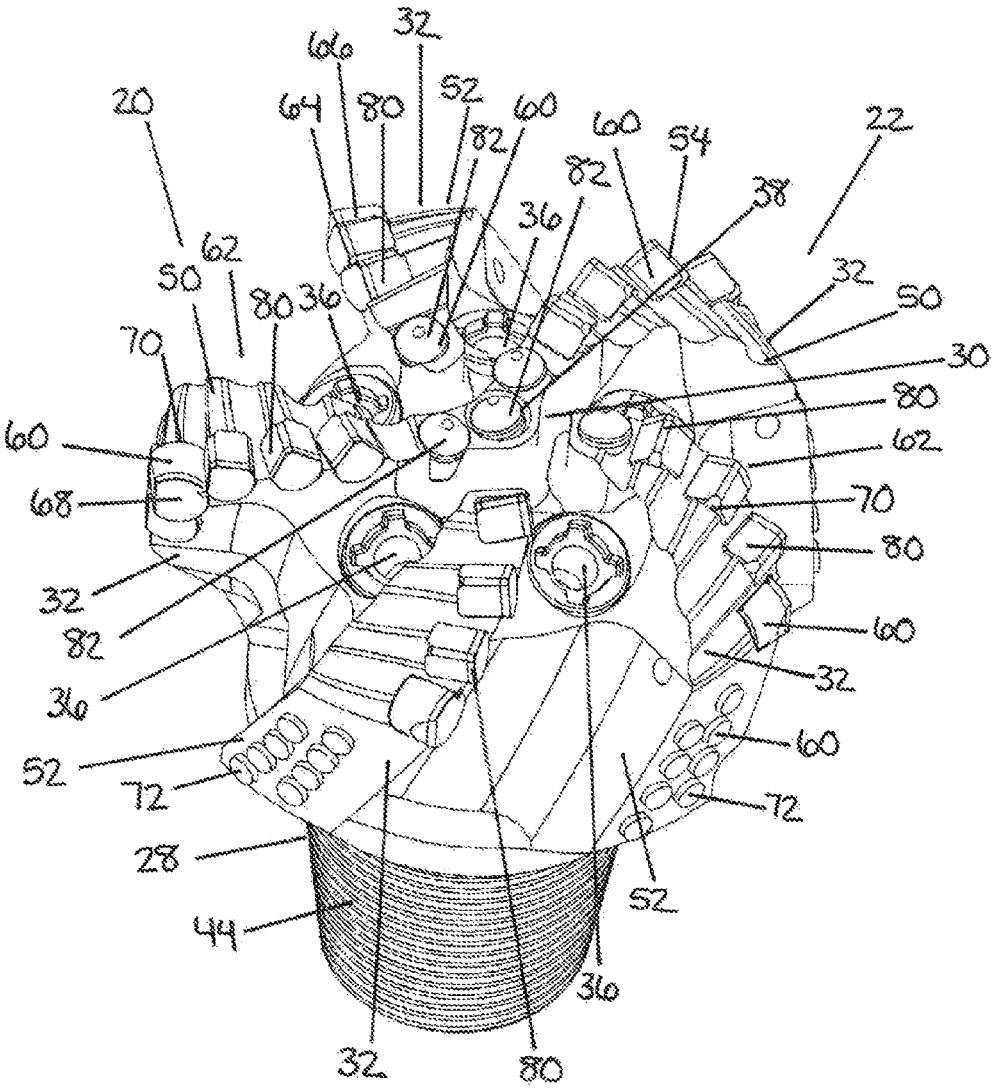
FIG. 2 is a pictorial view of a second embodiment of drill bit including features of the invention.
Figure 3:
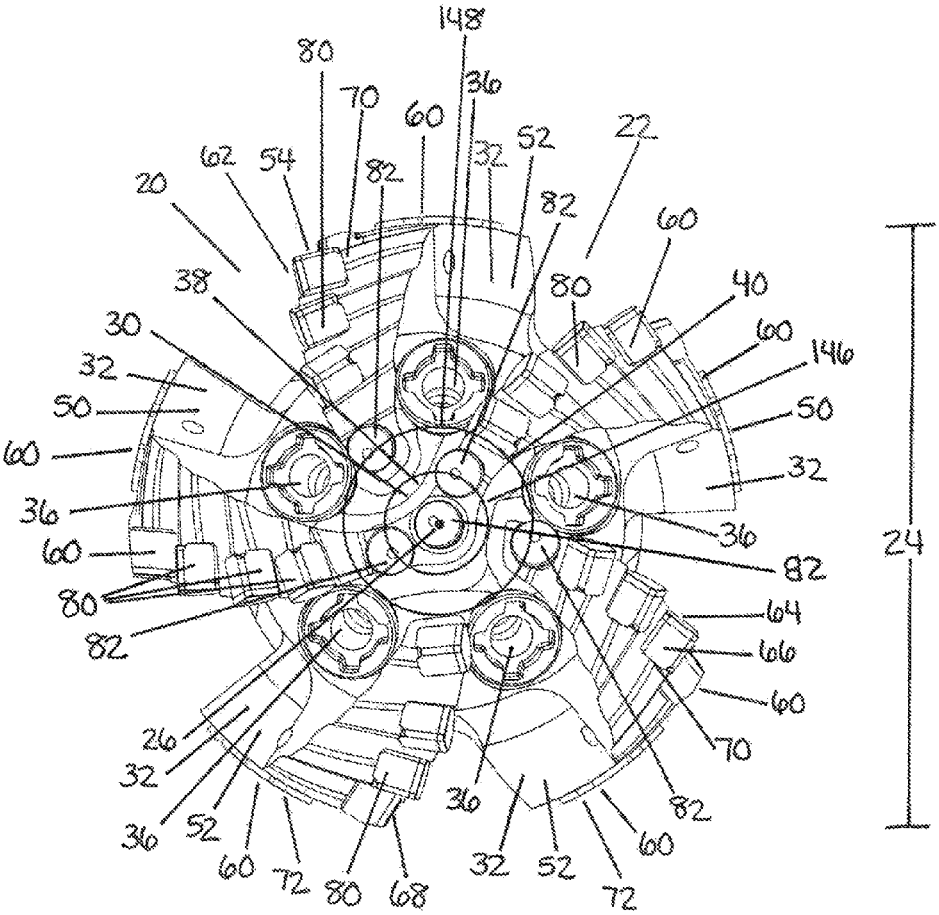
FIG. 3 is an end view of the distal end of the second embodiment of drill bit depicted in FIG. 2.

Referring to FIGS. 1-3, a fixed cutter drill hit (20) is comprised of a drill bit body (22) and has a gauge diameter (24).

The drill bit body (22) has a drill bit body axis (26). The drill bit body (22) has a proximal end (28) which is adapted for connecting with a drill string (not shown), a distal end (30) and a plurality of blades (32). The drill bit body (22) defines a bit bore (not shown) which extends through the drill bit body (22) from the proximal end (28) and a plurality of nozzles (36) adjacent to the distal end (30) which communicate with the bit bore to provide a path for a drilling fluid (not shown) to be passed through the drill string and the drill bit (20). The drill bit body (22) also defines a cone recess (38) having a cone recess diameter (40). The center of the cone recess diameter (40) coincides with the drill bit body axis (26).

In the embodiments depicted in the Figures, the drill bit body (22) may be constructed of steel and the drill bit body (22) may be milled as one piece from a single block of steel. Alternatively, the drill bit body (22) may be constructed from a plurality of components which are subsequently connected together.

In the embodiments depicted in the Figures, the proximal end (28) of the drill bit body (22) is comprised of a threaded pin connector (44).

In the embodiments depicted in the Figures, the drill bit body (22) is comprised of five blades (32) which extend as spirals from the distal end (30) of the drill bit body (22) toward the proximal end of the drill bit body (22). Two of the blades (32) are primary blades (50) which extend radially to the drill bit body axis (26) and three of the blades (32) are secondary blades (52) which do not extend radially to the drill bit body axis (26).

The blades (32) define a cutting profile (54) which extends radially between the drill bit body axis (26) and the gauge diameter (24).

A plurality of cutters (60) is attached to the blades (32). The cutters (60) are distributed on the blades (32) in a cutter layout (62) along the cutting profile (54).

The cutters (60) are comprised of cutter elements (64) and substrates (66). The cutter elements (64) are affixed to the substrates (66).

In the embodiments depicted in the Figures, the cutter elements (64) may be constructed of polycrystalline diamond compact (PDC) or any other suitable material. The cutter elements (64) comprise cutting faces (68). The cutting faces (68) contact the borehole (not shown) during drilling to perform a shearing action.

In the embodiment of the invention depicted in the Figures, the substrates (66) may be constructed of tungsten carbide or any other suitable material.

The drill bit body (22) defines cutter pockets (70) along the blades (32). The cutters (60) are received in the cutter pockets (70) for positioning of the cutters (60) on the blades (32). In the embodiment depicted in the Figures, the cutters (60) may be attached to the blades (32) by brazing the substrates (66) into the cutter pockets (70).

In addition to the cutters (60) which are provided in the cutter layout (62), a plurality of gauge cutters (72) are located on each of the blades (32) between the proximal end (28) and the distal end (30) of the drill bit body (22). As depicted in the Figures, the gauge cutters (72) include active gauge "trimmer" cutters and passive gauge or gauge pad cutters.

The cutter layout (62) defines exposures, siderake angles, backrake angles, cutting edges and cutting paths for individual cutters (60) in the cutter layout (62). The cutter layout (62) also defines effective cutting edges and effective cutting paths for all of the cutters (60) in the cutter layout (62), having regard to cutter offsets and relative exposures of the cutters (60).

Referring to FIG. 1 and FIG. 24, the cutter layout (62) of the first embodiment of fixed cutter drill bit (20) includes a plurality of hybrid cutters (80) and one contoured cutter (82). Referring to FIG. 2 and FIG. 3, the cutter layout (62) of the second embodiment of fixed cutter drill bit (20) includes a plurality of hybrid cutters (80) and a plurality of contoured cutters (82).

Figure 4:
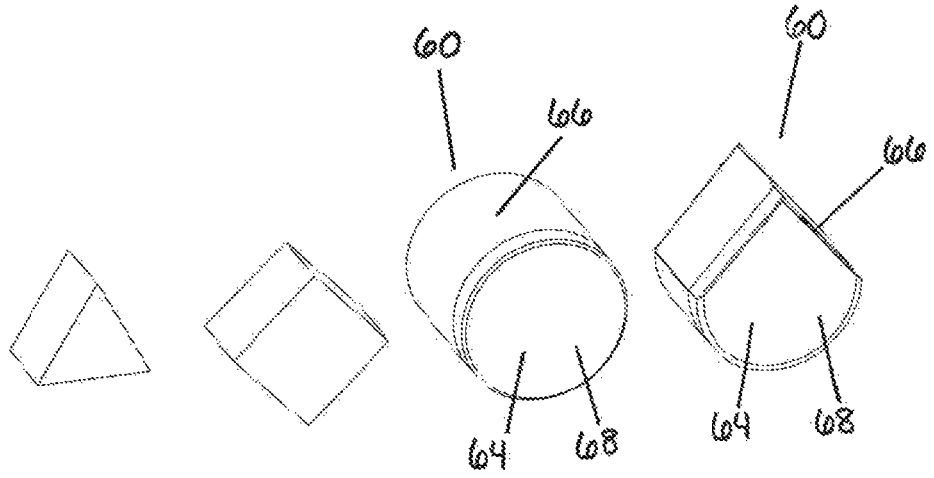
FIG. 4 is a depiction of geometric shapes which may be represented in hybrid cutters according to the invention.

Referring to FIG. 4, a number of possible geometric shapes for fixed cutters are depicted schematically. These geometric shapes illustrate the manner in which the hybrid cutters (80) of the invention combine features of angular cutters and curved cutters and depict the "evolution" of the hybrid cutters (80) from angular cutters and curved cutters, culminating in the hybrid cutter (80) shown at the far right side of FIG. 4.

Figure 5:
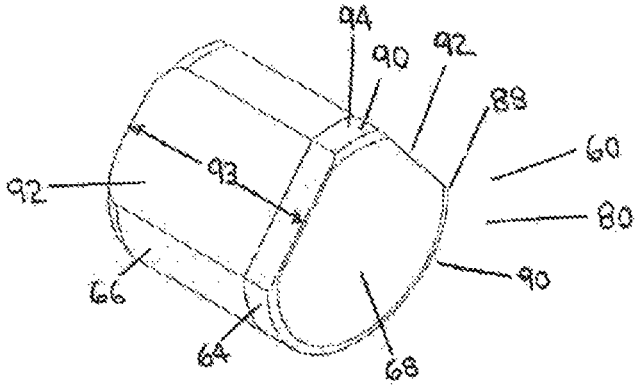
FIG. 5 is a pictorial view of an embodiment of a hybrid cutter according to the invention which incorporates features of the geometric shapes of FIG. 4.
Figure 6:
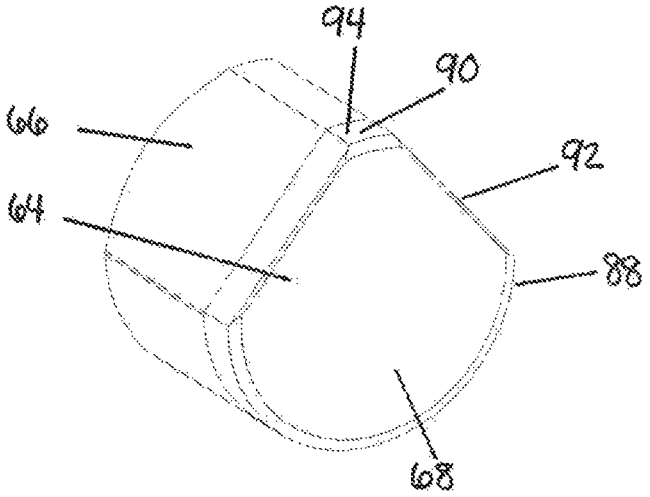
FIG. 6 is a detail view of the curved cutter tip of the hybrid cutter depicted in FIG. 5.

Referring to FIG. 5 and FIG. 6, an embodiment of a hybrid cutter (80) is depicted, wherein the embodiment is a refined version of the hybrid cutter (80) shown in FIG. 4. In FIG. 5, the hybrid cutter (80) is comprised of a cutter element (64) and a substrate (66). The cutter element (90) defines a cutting face (68). The cutting face (68) has a perimeter (88). In the embodiment of FIGS. 5-6, the cutting face (68) is comprised of a substantially continuous curve (90), interrupted by two arc discontinuities (92). In the embodiment of FIGS. 5-6, the substantially continuous curve (90) is substantially circular, and the two arc discontinuities (92) are straight discontinuities which may be described as chords in the cutting face (68). In the embodiment of FIGS. 5-6, the two arc discontinuities (92) extend for the full length (93) of the cutter (60).

In the embodiment of FIGS. 5-6, the cutting face (68) is further comprised of a curved cutter tip (94) between the two arc discontinuities (92). The curved cutter tip (94) is a portion of the substantially continuous curve (90).

The embodiment of hybrid cutter (80) depicted in FIGS. 5-6 is substantially symmetrical about the curved cutter tip (94). When the embodiment of hybrid cutter (80) of FIGS. 5-6 is positioned on the drill bit body (22), a portion of the cutting face (68) will exhibit an exposure (96) which defines a cutter centerline (98) normal to the drill bit body (22). The perimeter around the portion of the cutting face (68) which exhibits the exposure (96) will provide a cutting edge (100). Preferably, the hybrid cutter (80) is positioned on the drill bit body (22) no that the two arc discontinuities (92) do not intersect the cutter centerline (98) and so that the cutter centerline (98) intersects the curved cutter tip (94). More preferably, the hybrid cutter (80) is positioned on the drill bit body (22) so that the portion of the cutting face (68) which exhibits the exposure (96) is substantially symmetrical about the cutter centerline (98).

Referring to FIGS. 7-16, various embodiments of hybrid cutters (80) and configurations of hybrid cutters (80) are depicted. In the description of FIGS. 7-16 which follows, features of the hybrid cutters (80) which correspond to features of the embodiment of hybrid cutter (80) of FIGS. 5-6 share the reference numbers used for the embodiment of FIGS. 5-6.

Figure 7:
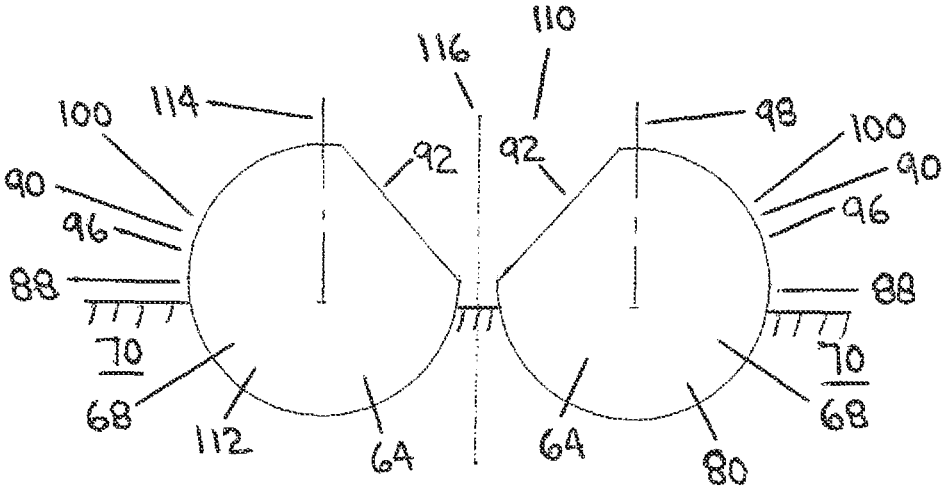
FIG. 7 is a view of the cutting faces of a pair of adjacent hybrid cutters according to an embodiment of the invention, arranged in an embodiment of a combined cutter configuration according to the invention.
Figure 8:
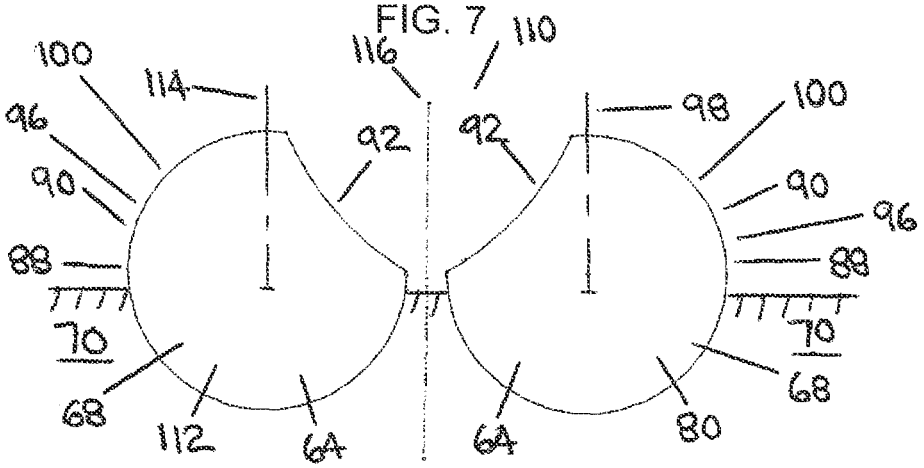
FIG. 8 is a view of the cutting faces of a pair of adjacent hybrid cutters according to an embodiment of the invention, arranged in an embodiment of a combined cutter configuration according to the invention.
Figure 9:
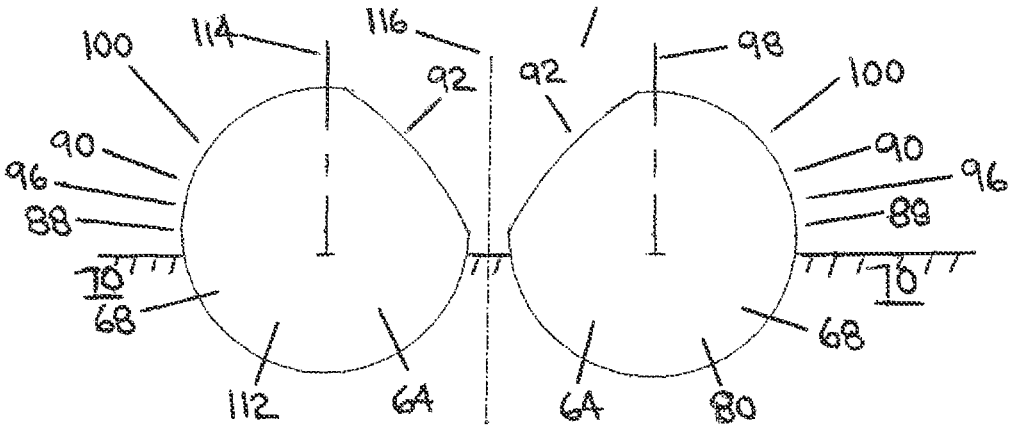
FIG. 9 is a view of the cutting faces of a pair of adjacent hybrid cutters according to an embodiment of the invention, arranged in an embodiment of a combined cutter configuration according to the invention.

FIGS. 7-9 depict combined cutter configurations (110) for several embodiments of two hybrid cutters (80) according to the first aspect of the invention. In all of FIGS. 7-9, the combined cutter configuration (110) is comprised of a hybrid cutter (80) and a second hybrid cutter (112). The hybrid cutter (80) and the second hybrid cutter (112) are depicted in FIGS. 7-9 as positioned on the drill bit body (22).

In each of FIGS. 7-9, the hybrid cutter (80) and the second hybrid cutter (112) are substantially identical to each other. In all of FIGS. 7-9, each of the hybrid cutter (80) and the second hybrid cutter (112) is comprised of a substantially continuous curve (90) interrupted by one arc discontinuity (92). In all of FIGS. 7-9, the substantially continuous curve (90) is substantially circular. In FIG. 7, the one arc discontinuity (92) is a substantially straight discontinuity. In FIG. 8, the one arc discontinuity (92) is a substantially concave discontinuity. In FIG. 9, the one arc discontinuity (92) is a substantially convex discontinuity. In all of FIGS. 7-9, the arc discontinuities (92) extend for the full length (not shown in FIGS. 7-9) of the cutter (60).

In each of FIGS. 7-9, the hybrid cutter (80) defines a cutter centerline (98) normal to the drill bit body (22) and the second hybrid cutter (112) defines a second cutter centerline (114) normal to the drill bit body (22). In each of FIGS. 7-9, the cutter centerline (98) and the second cutter centerline (114) are substantially parallel to each other. In each of FIGS. 7-9, the combined cutter configuration (100) defines a combined cutter centerline (116).

In each of FIGS. 7-9, the one arc discontinuity (92) of the hybrid cutter (80) does not intersect the cutter centerline (98) and the one arc discontinuity (92) of the second hybrid cutter (112) does not intersect the second cutter centerline (114). In each of FIGS. 7-9, the one arc discontinuity (92) of the hybrid cutter (80) and the one arc discontinuity (92) of the second hybrid cutter (112) are facing each other. In each of FIGS. 7-9, the combined cutter configuration (110) is substantially symmetrical about the combined cutter centerline (116).

Figure 10:
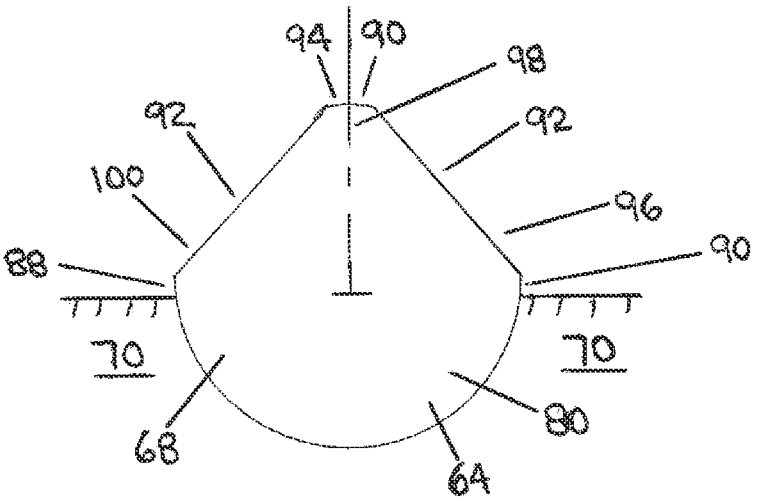
FIG. 10 is a view of the cutting face of an embodiment of a hybrid cutter according to the invention.
Figure 11:
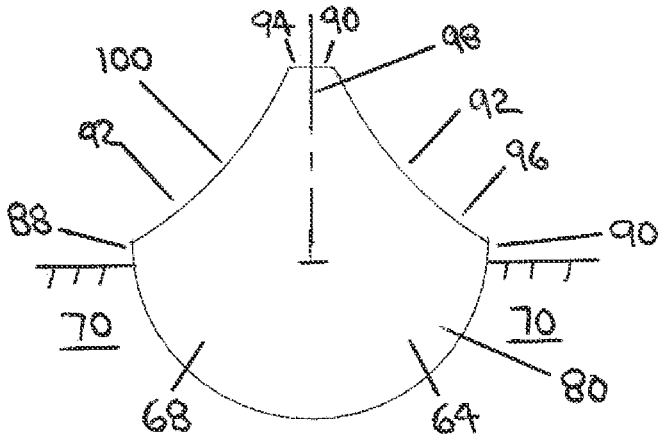
FIG. 11 is a view of the cutting face of an embodiment of a hybrid cutter according to the invention.
Figure 12:
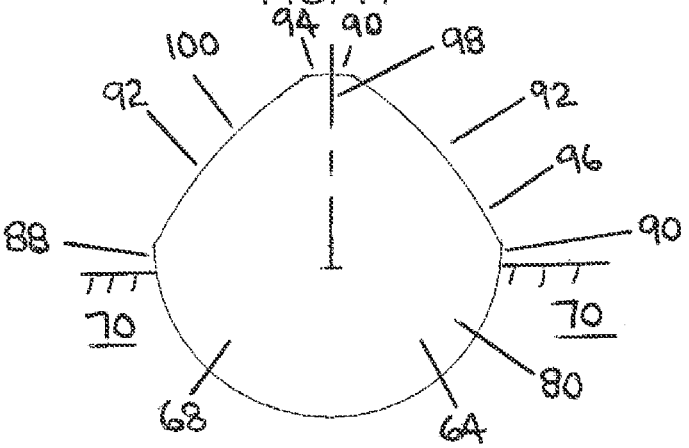
FIG. 12 is a view of the cutting face of an embodiment of a hybrid cutter according to the invention.

FIGS. 10-12 depict several further embodiments of hybrid cutters (80) according to the first aspect of the invention.

In all of FIGS. 10-12, each of the hybrid cutters (80) is comprised of a substantially continuous curve (90) interrupted by two arc discontinuities (92). In all of FIGS. 10-12, the substantially continuous curve (90) is substantially circular. In all of FIGS. 10-12, the cutting edge (100) of the hybrid cutters (80) is further comprised of curved cutter tips (94) between the arc discontinuities (92). In FIG. 10, each of the two arc discontinuities (92) is a substantially straight discontinuity. In FIG. 11, each of the two arc discontinuities (92) is a substantially concave discontinuity. In FIG. 12, each of the two arc discontinuities (92) is a substantially convex discontinuity. In all of FIGS. 10-12, each of the two arc discontinuities (92) extends for the full length (not shown in FIGS. 10-12) of the cutter (60).

In each of FIGS. 10-12, the hybrid cutter (80) defines a cutter centerline (98) normal to the drill bit body (22).

In each of FIGS. 10-12, the two arc discontinuities (92) of the hybrid cutter (80) do not intersect the cutter centerline (98). In each of FIGS. 10-12, the cutter centerline (98) intersects one of the curved cutter tips (94). In each of FIGS. 10-12, the hybrid cutter (80) is substantially symmetrical about the cutter centerline (98).

FIGS. 13-16 depict several further embodiments of hybrid cutters (80) according to the first aspect of the invention.

Figure 13:
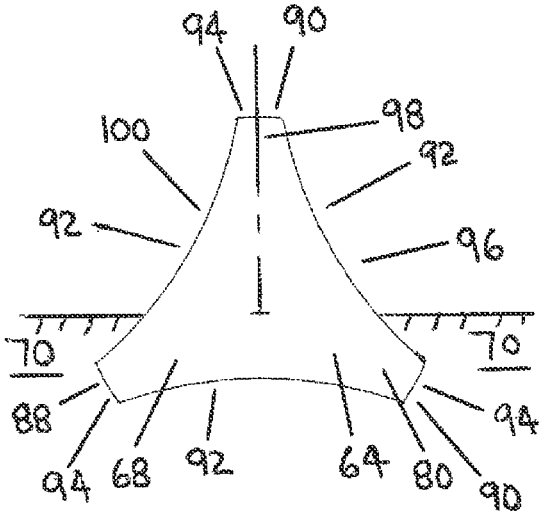
FIG. 13 is a view of the cutting face of an embodiment of a hybrid cutter according to the invention.
Figure 14:
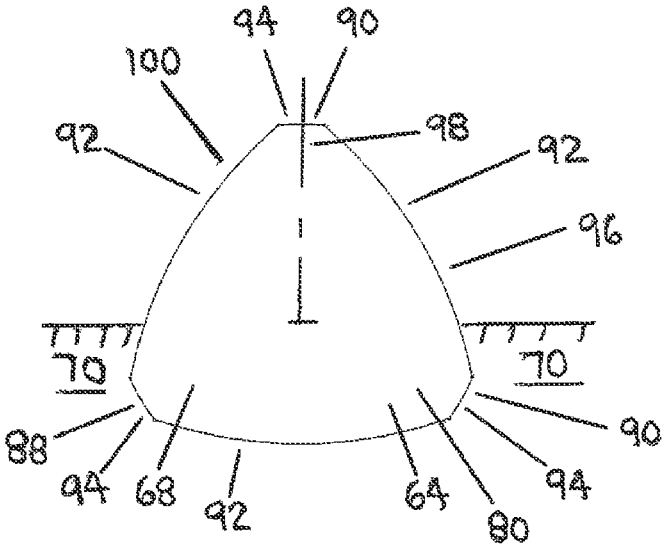
FIG. 14 is a view of the cutting face of an embodiment of a hybrid cutter according to the invention.
Figure 15:
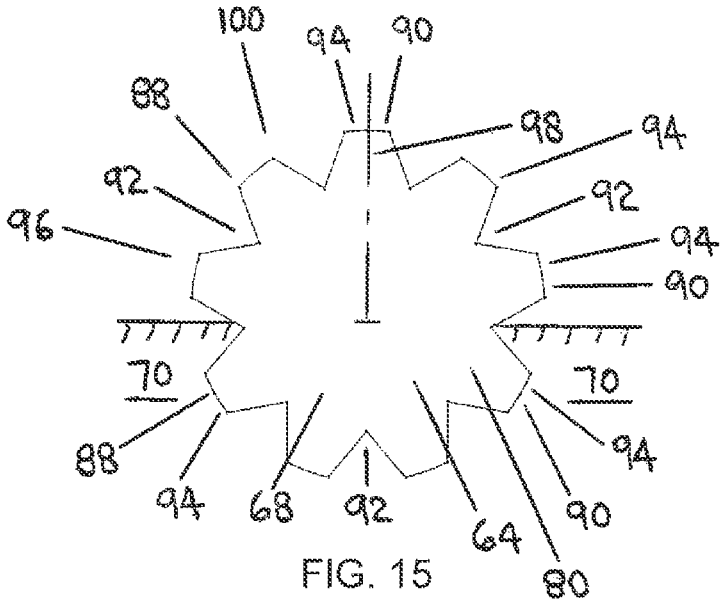
FIG. 15 is a view of the cutting face of an embodiment of a hybrid cutter according to the invention.
Figure 16:
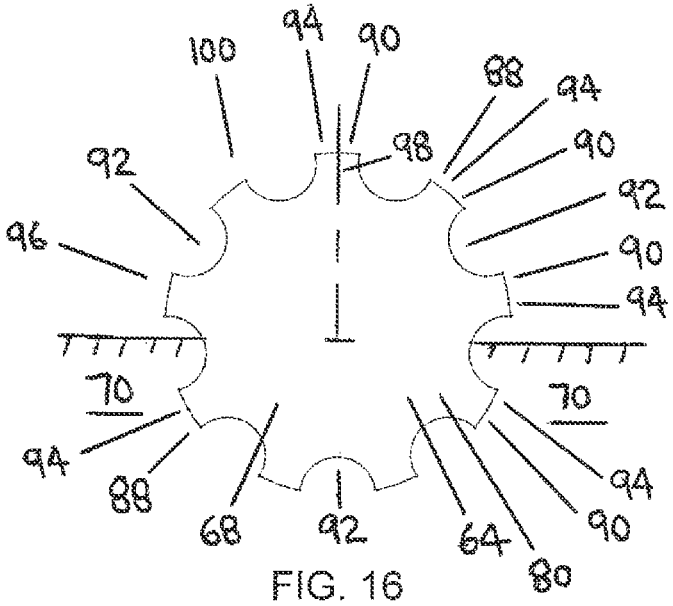
FIG. 16 is a view of the cutting face of an embodiment of a hybrid cutter according to the invention.

In all of FIGS. 13-16, each of the hybrid cutters (80) is comprised of a substantially continuous curve (90) interrupted by at least three arc discontinuities (92). In all of FIGS. 13-16, the substantially continuous curve (90) is substantially circular. In all of FIGS. 13-16, the cutting edge (100) of the hybrid cutters (80) is further comprised of curved cutter tips (94) between the arc discontinuities (92). In FIG. 13, each of the three arc discontinuities (92) is a substantially concave discontinuity. In FIG. 14, each of the three arc discontinuities (92) is a substantially convex discontinuity. In FIG. 15, each of the nine arc discontinuities (92) is a notch discontinuity. In FIG. 16, each of the nine arc discontinuities (92) is a substantially concave discontinuity. In all of FIGS. 13-16, each of the arc discontinuities (92) extends for the full length (not shown in FIGS. 13-16) of the cutter (60).

In each of FIGS. 13-16, the hybrid cutter (80) defines a cutter centerline (98) normal to the drill bit body (22).

In each of FIGS. 13-16, the arc discontinuities (92) of the hybrid cutter (80) do not intersect the cutter centerline (98). In each of FIGS. 13-16, the cutter centerline (98) intersects one of the curved cutter tips (94). In each of FIGS. 13-16, the hybrid cutter (80) is substantially symmetrical about the cutter centerline (98).

In each of FIGS. 13-16, the arc discontinuities (92) are substantially evenly spaced around the perimeter (88) of the cutting face (68). As a result, the cutter pockets (70) for the hybrid cutters (80) of FIGS. 13-16 may be provided with complementary surfaces (not shown) to receive one or more of the arc discontinuities (92). The arc discontinuities (92) and the complementary surfaces may assist in positioning the hybrid cutters (80) on the drill bit body (22) and may thus function as alignment aids. In addition, a worn or damaged cutting face (68) on the hybrid cutter (80) can be "changed" by turning the hybrid cutter (80) to change the portion of the cutting face (68) which exhibits the exposure (96) so that the hybrid cutter (80) can be re-used instead of discarded.

Figure 17:
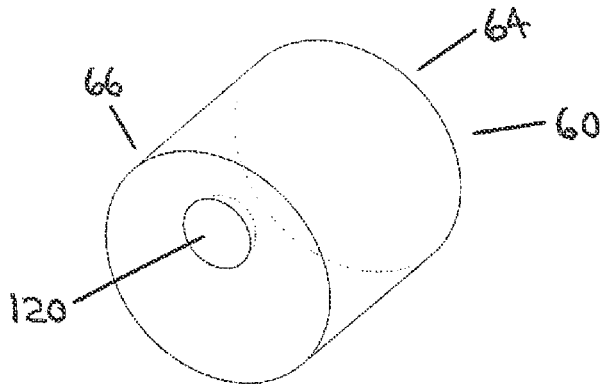
FIG. 17 is a pictorial view of an embodiment of a cutter for a fixed cutter drill bit, depicting an alignment aid associated with the cutter.
Figure 18:
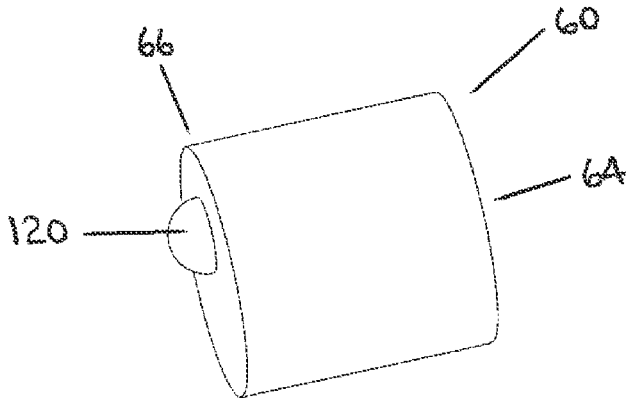
FIG. 18 is a pictorial view of an embodiment of a cutter for a fixed cutter drill bit, depicting an alignment aid associated with the cutter.
Figure 19:
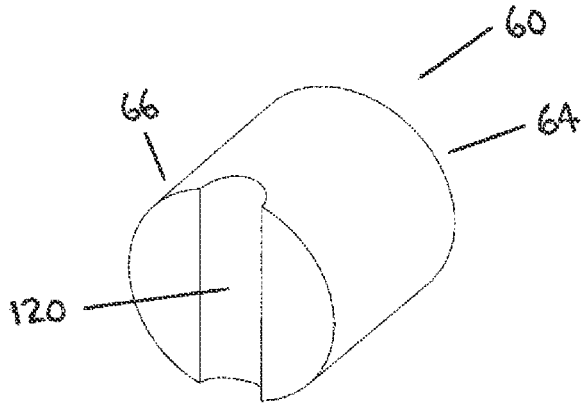
FIG. 19 is a pictorial view of an embodiment of a cutter for a fixed cutter drill bit, depicting an alignment aid associated with the cutter.
Figure 20:
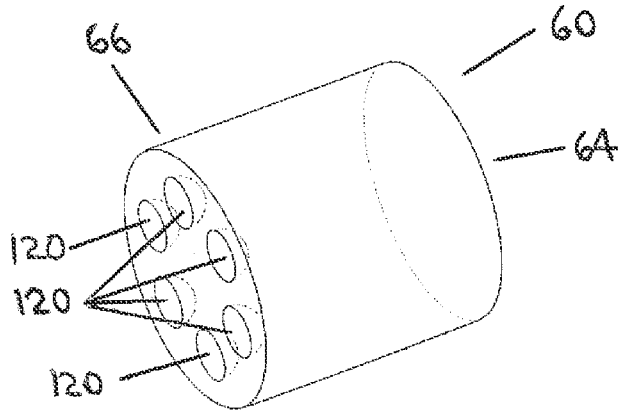
FIG. 20 is a pictorial view of an embodiment of a cutter for a fixed cutter drill hit, depicting an alignment aid associated with the cutter.
Figure 21:
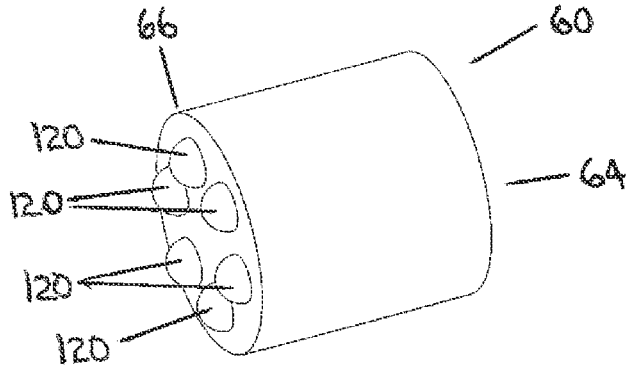
FIG. 21 is a pictorial view of an embodiment of a cutter for a fixed cutter drill bit, depicting an alignment aid associated with the cutter.

FIGS. 17-22 depict several embodiments of alignment aids (120) which may be suitable for hybrid cutters (80) and for other cutters (60) positioned on the drill bit body (22). FIG. 17 depicts a single hole which may be provided on the end of the substrate (66) opposite the cutter element (64) and which may be complementary with a lug (not shown) in a cutter pocket (70). FIG. 18 depicts a single lug which may be provided on the end of the substrate (66) opposite the cutter element (64) and which may be complementary with a hole (not shown) in a cutter pocket (70). FIG. 19 depicts a single groove which may be provided on the end of the substrate (66) opposite the cutter element (64) and which may be complementary with a lug (not shown) in a cutter pocket (70). FIG. 20 depicts a plurality of holes which may be provided on the end of the substrate (66) opposite the cutter element (64) and which may be complementary with a plurality of lugs (not shown) in a cutter pocket (70). FIG.

Figure 22:
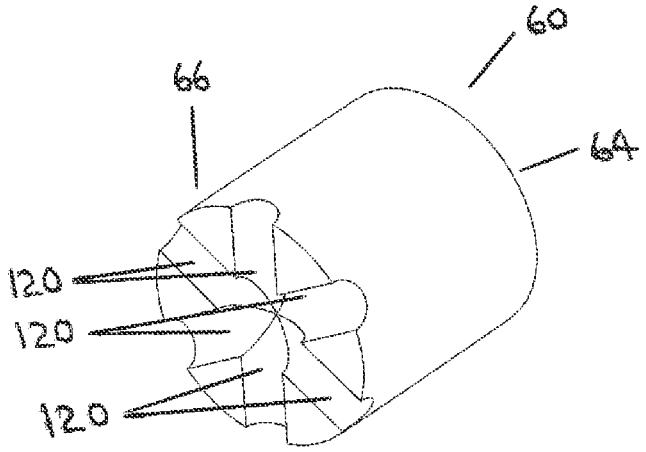
FIG. 22 is a pictorial view of an embodiment of a cutter for a fixed cutter drill bit, depicting an alignment aid associated with the cutter.

21 depicts a plurality of lugs which may be provided on the end of the substrate (66) opposite the cutter element (64) and which may be complementary with a plurality of holes (not shown) in a cutter pocket (70). FIG. 22 depicts a plurality of grooves which may be provided on the end of the substrate (66) opposite the cutter element (64) and which may be complementary with a plurality of lugs (not shown) in a cutter pocket (70).

Referring again to FIG. 1 and FIG. 21 depicting the first embodiment of drill bit (20) and FIGS. 2-3 depicting the second embodiment of drill bit (20), each of the first embodiment and the second embodiment include a similar configuration of hybrid cutters (80). Specifically, each of the five blades (32) of the drill bit (20) includes four hybrid cutters (80). Of these four hybrid cutters (80), three hybrid cutters (80) are similar to the embodiment of hybrid cutter (80) depicted in FIGS. 4-5 and FIG. 10 and are positioned on the distal end (30) of the drill bit body (22).

The fourth hybrid cutter (80) on each blade (32) is similar to the embodiment of hybrid cutter (80) depicted in FIG. 7 and is positioned on the side of the drill bit body (22). As depicted in FIG. 1 and FIG. 24 and FIGS. 2-3, the one arc discontinuity (92) of the fourth hybrid cutter (80) is tapered along the length of the cutter element (64) and does not extend to the substrate (66) or along any portion of the length of the substrate (66).

In other embodiments of a drill bit (20) according to the invention, fewer or more hybrid cutters (80) may be provided than are depicted in FIG. 1 and FIG. 24 and FIGS. 2-3, the hybrid cutters (80) may be configured on the drill bit body (22) in a different manner than is depicted in FIG. 1 and FIG. 24 and FIGS. 2-3, and the hybrid cutters (80) may consist of or may include other embodiments of hybrid cutter (80) as described herein than are depicted in FIG. 1 and FIG. 24 and FIGS. 2-3.

Figure 23:
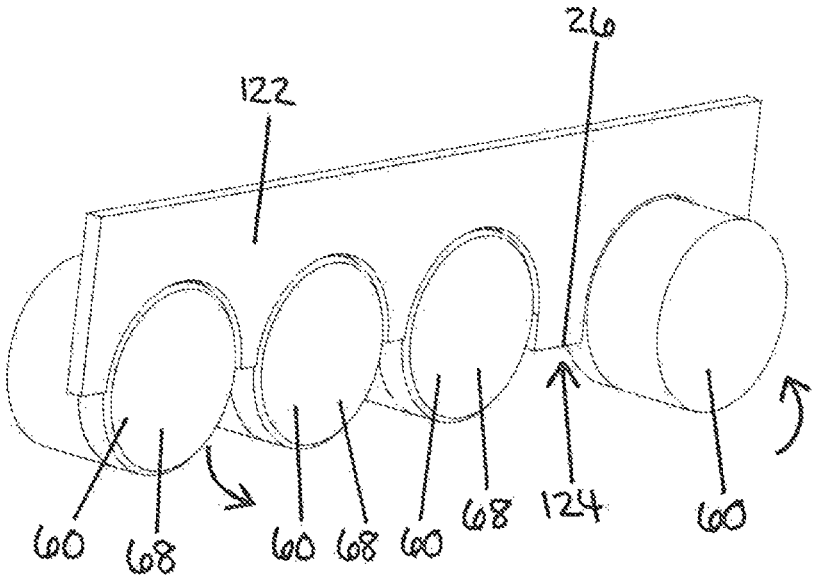
FIG. 23 is a schematic view of the distal end of a prior art fixed cutter drill bit body and a borehole being contacted by the drill bit, depicting a core of undrilled material being formed at the drill bit body axis.

Referring to FIG. 23, a schematic view is provided of the distal end (30) of a fixed cutter drill bit body (22) and a borehole (122) being contacted by the drill bit (20), depicting a core (124) of undrilled material being formed at the drill bit body axis (26). Although this core (124) of undrilled material may enhance the stability of the drill bit (20), the core (124) may also impose undesirable side loading on cutters (60) positioned adjacent to the drill bit body axis (26).

FIGS. 24-28 depict several embodiments of contoured cutters (82) according to the second aspect of the invention. FIG. 1 and FIG. 24 provide an exemplary configuration for contoured cutters (82) on the first embodiment of drill bit (20). FIG. 2 and FIG. 3 provide an alternate exemplary configuration for contoured cutters (82) on the second embodiment of drill bit (20).

Referring to FIG. 1 and FIG. 24, an exemplary configuration of contoured cutters (82) is depicted on the first embodiment of drill bit (20). As depicted in FIGS. 1 and 24, the first embodiment of drill bit (20) is comprised of a single contoured cutter (82).

FIG. 24 is a detail view of the distal end (30) of the drill bit body (22) at the drill bit body axis (26) of the first embodiment of drill bit (20) depicted in FIG. 1. FIG. 24 depicts an embodiment of a contoured cutter (82) which is configured as a "center cutter". The contoured cutter (82) depicted in FIG. 24 comprises a cutter element (64) and a cutter substrate (66). The cutter element (64) defines a cutting face (68).

The cutting face (68) is a contoured cutting face which is comprised of a raised shape (130) extending away from the distal end (30) of the drill bit body (22) in a distal direction. The contoured cutter (82) defines a center cutter axis (132). The raised shape (130) defines a raised shape axis (134). As depicted in FIG. 24, the raised shape axis (134) is coincident with the center cutter axis (132). As a result, the contoured cutter (82) is tilted in its cutter pocket (70) so that the raised shape axis (134) is oblique to the drill bit body axis (26). As depicted in FIG. 24, the raised shape axis (134) intersects the drill bit body axis (26).

As depicted in FIG. 24, the raised shape (130) is substantially cone-shaped between a base (136) and a tip (138). In particular, as depicted in FIG. 24, the raised shape (130) is substantially a "straight cone" in which the sides of the raised shape (130) are substantially straight and provide a taper between the base (136) and the tip (138). As depicted in FIG. 24, the tip (138) of the raised shape (130) is substantially spherical.

Referring to FIG. 2 and FIG. 3, an alternate exemplary configuration of contoured cutters (82) is depicted. As depicted in FIGS. 2-3, the second embodiment of drill bit (20) is comprised of five contoured cutters (82).

Referring to FIG. 3, one of the contoured cutters (82) is configured as a "center cutter", two of the contoured cutters (82) are positioned on the drill bit body (22) so that the tips (138) of the contoured cutters (82) are located at a first diameter (146) from the drill bit body axis (26) and two of the contoured cutters (82) are positioned on the drill bit body (22) so that the tips (138) of the contoured cutters (82) are located at a second diameter (148) from the drill bit body axis (26).

The first diameter (146) and/or the second diameter (148) may be considered to define a center portion of the drill bit (20) so that the contoured cutters (82) may be considered to be positioned within a center portion of the drill bit (20). In some embodiments of the second aspect, one of the first diameter (146) or the second diameter (148) may coincide with the cone recess diameter (40).

The configuration of a plurality of contoured cutters (82) depicted in FIGS. 2-3 is exemplary only, and other configurations of a plurality of contoured cutters (82) may be provided.

In the alternate configuration of contoured cutters (82) depicted in FIGS. 2-3, each of the contoured cutters (82) comprises a cutter element (64) and a substrate (66). The cutter element (64) of each of the contoured cutters (82) defines a cutting face (68).

The cutting face (68) of each of the contoured cutters (82) depicted in FIGS. 2-3 is a contoured cutting face which is comprised of a raised shape (130) extending away from the distal end (30) of the drill bit body (22) in a distal direction. The center cutter defines a center cutter axis (132) and the other contoured cutters (82) define a contoured cutter axis (160). The raised shape (130) of each of the contoured cutters (82) defines a raised shape axis (134). As depicted in FIGS. 2-3, each of the contoured cutters (82) is tilted in its respective cutter pocket (70) so that the raised shape axis (134) of each of the contoured cutters (82) is oblique to the drill bit body axis (26). The raised shape axis (134) of the center cutter intersects the drill bit body axis (26).

As depicted in FIGS. 2-3, the raised shape (130) of each of the contoured cutters (82) is substantially cone-shaped between a base (136) and a tip (138). In particular, as depicted in FIGS. 2-3, the raised shape (130) is substantially a "straight cone" in which the sides of the raised shape (130) are substantially straight and provide a taper between the base (136) and the tip (138). As depicted in FIG. 24, the tip (138) of the raised shape (130) of each of the contoured cutters (82) is substantially spherical.

Figure 25:
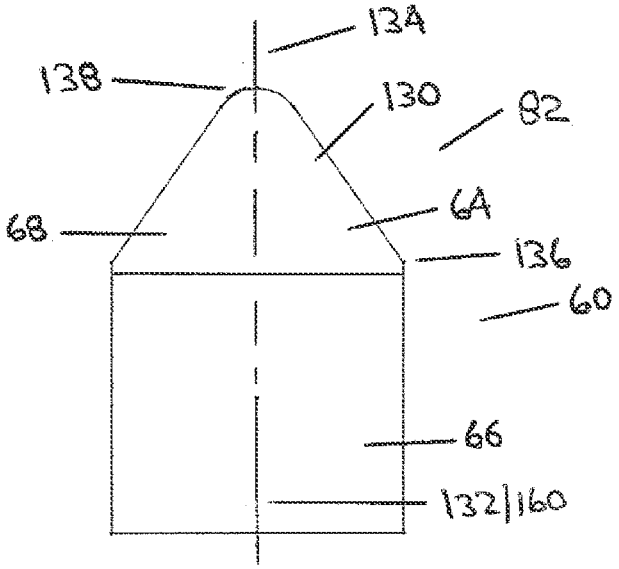
FIG. 25 is a side view of an embodiment of a contoured cutter according to the invention.
Figure 26:
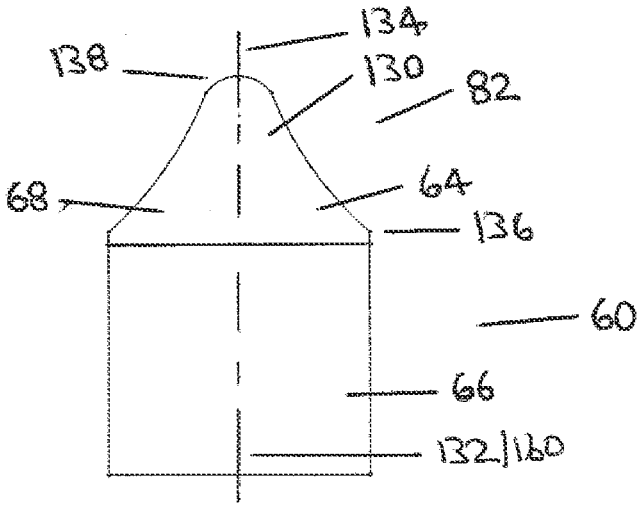
FIG. 26 is a side view of a contoured cutter according to the invention.
Figure 27:
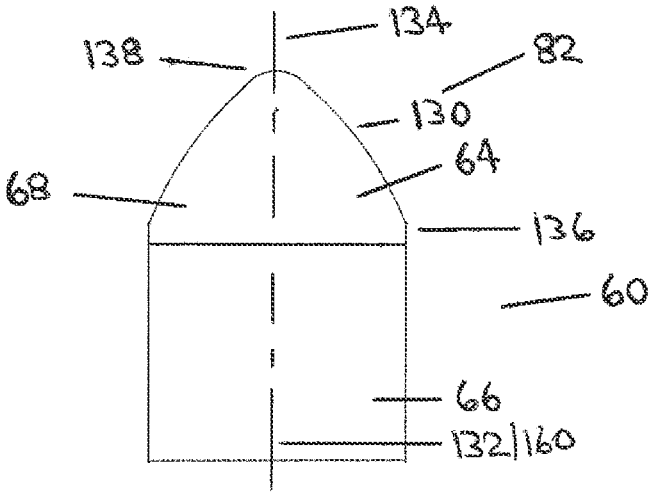
FIG. 27 is a side view of an embodiment of a contoured cutter according to the invention.
Figure 28:
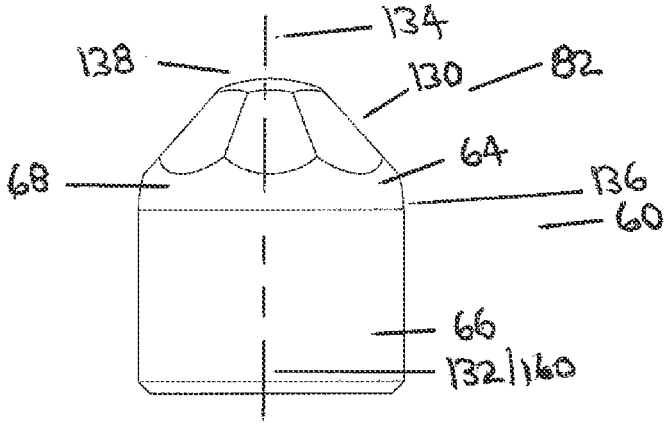
FIG. 28 is a side view of an embodiment of a contoured cutter according to the invention.
Figure 29:
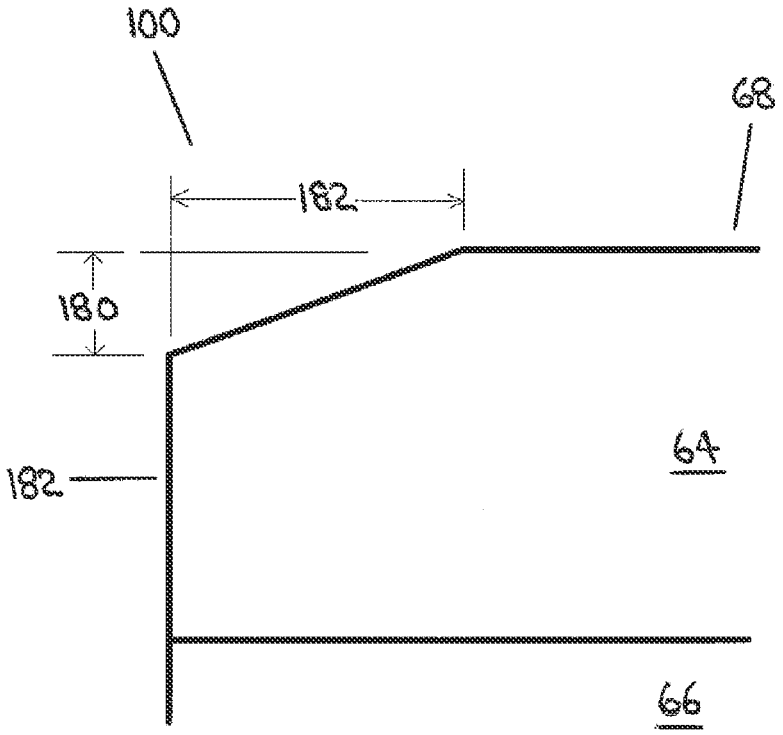
FIG. 29 is a schematic view of an embodiment of an embodiment of a chamfer of a cutting edge of a cutter according to the invention.

FIGS. 25-28 provide side views depict various embodiments of contoured cutters (82) in which the raised shapes (130) are substantially cone-shaped. FIG. 25 depicts a substantially straight cone, FIG. 26 depicts a substantially concave cone, FIG. 27 depicts a substantially convex cone, and FIG. 28 depicts a substantially polygonal cone. In some embodiments of the second aspect, other substantially cone-shaped shapes may be provided for the raised shape (130), and shapes other than cones may be utilized for the contoured cutters (82).

In other embodiments of a drill bit (20) according to the invention, fewer or more contoured cutters (82) than are depicted in FIG. 1 and FIG. 24 and FIGS. 2-3 may be provided, the contoured cutters (82) may be configured on the drill bit body (22) in a different manner than is depicted in FIG. 1 and FIG. 24 and FIGS. 2-3, and the contoured cutters (82) may consist of or may include other embodiments of contoured cutter (82) as described herein than are depicted in FIG. 1 and FIG. 24 and FIGS. 2-3.

Referring to FIG. 29, an exemplary embodiment of a chamfer for a cutter (60) according to the third aspect of the invention is depicted. The chamfer may be applied to hybrid cutters (80) or to other types of fixed cutter. The chamfer may be applied to all of the edges of a fixed cutter, only to some of the edges of a fixed cutter, and/or only to portions of one or more edges of a fixed cutter.

As depicted in FIG. 29, the cutter (60) is comprised of a cutter element (64) and a substrate (66). The cutter element (64) defines a cutting face (68) and a side (168) adjacent to the cutting face (68). The cutting face (68) has a perimeter (88). The perimeter (88) of the cutting face (68) defines an edge between the cutting face (68) and the side (168) of the cutter element (64).

At least a portion of the edge is chamfered to provide a transition between the cutting face (68) and the side (168) of the cutter element (64). The chamfer is comprised of a side bevel (180) and a cutting face bevel (182). The side bevel (180) has a side bevel length and the cutting face bevel (182) has a cutting face bevel length.

In the third aspect of the invention, the cutting face bevel length is at least two times the side bevel length. In some embodiments of the third aspect, the side bevel length is less than about 0.3 millimeters (about 0.012 inches).

In some embodiments of the third aspect, the chamfer of the invention may be subjected to finish grinding or to some other finishing procedure or procedures to enhance the performance of the cutter (60) and/or the chamfer. In some embodiments of the third aspect, the finish grinding may be comprised of providing a micro bevel or a round to the angles between the cutting face (68), the side (168) and/or the bevels (180, 182).

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A fixed cutter drill bit comprising:

(a) a drill bit body having a distal end and a drill bit body axis; and (b) a contoured cutter positioned on the distal end of the drill bit body, wherein the contoured cutter comprises a cutter element, wherein the cutter element defines a cutting face, wherein the cutting face is a contoured cutting face, wherein the contoured cutting face is comprised of a raised shape extending away from the distal end of the drill bit body in a distal direction, wherein the raised shape defines a raised shape axis, wherein the raised shape axis is oblique to the drill bit body axis, wherein the contoured cutter is a center cutter, and wherein the center cutter is positioned on the distal end of the drill bit body such that the raised shape axis of the center cutter intersects the drill bit body axis.

2. The fixed cutter drill bit as claimed in claim 1 wherein the drill bit is comprised of a plurality of contoured cutters, wherein each of the contoured cutters is positioned on the distal end of the drill bit body, wherein each of the contoured cutters comprises a cutter element, wherein the cutter element defines a cutting face, wherein the cutting face is a contoured cutting face, wherein the contoured cutting face is comprised of a raised shape extending away from the distal end of the drill bit body in the distal direction, wherein the raised shape defines a raised, shape axis, and wherein the raised shape axis is oblique to the drill bit body axis.

3. The fixed cutter drill bit as claimed in claim 1 wherein the center cutter defines a center cutter axis and wherein the center cutter axis is coincident with the drill bit body axis.

4. The fixed cutter drill bit as claimed in claim 1 wherein the raised shape is cone-shaped between a base and a tip.

5. The fixed cutter drill bit as claimed in claim 4 wherein the raised shape is selected from the group of shapes consisting of a straight cone, a concave cone, a convex cone, and a polygonal cone.

6. The fixed cutter drill bit as claimed in claim 5 wherein the tip of the raised shape is spherical.

* * * * *